US007892113B2

(12) United States Patent
Egashira et al.

(10) Patent No.: US 7,892,113 B2
(45) Date of Patent: Feb. 22, 2011

(54) GOLF BALL

(75) Inventors: Yoshinori Egashira, Chichibu (JP); Eiji Takehana, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/372,139

(22) Filed: Mar. 10, 2006

(65) Prior Publication Data

US 2006/0205534 A1 Sep. 14, 2006

(30) Foreign Application Priority Data

Mar. 14, 2005 (JP) ..... 2005-070193

(51) Int. Cl.
*A63B 37/06* (2006.01)

(52) U.S. Cl. ..... 473/377

(58) Field of Classification Search ..... 473/351, 473/377

See application file for complete search history.

(56) References Cited

U.S. PATENT DOCUMENTS

| | | | | |
|---|---|---|---|---|
| 6,037,039 | A | 3/2000 | Koike et al. | |
| 6,211,325 | B1 * | 4/2001 | Sun et al. | 528/66 |
| 6,646,053 | B2 * | 11/2003 | Yokota et al. | 525/193 |
| 6,743,490 | B2 | 6/2004 | Fushihara et al. | |
| 6,878,076 | B2 * | 4/2005 | Winskowicz | 473/378 |
| 2004/0063803 | A1 * | 4/2004 | Kim et al. | 522/1 |
| 2004/0209701 | A1 * | 10/2004 | Finkel | 473/280 |
| 2004/0242345 | A1 * | 12/2004 | Emalfarb | 473/371 |

FOREIGN PATENT DOCUMENTS

| | | | |
|---|---|---|---|
| JP | 06-327795 | A | 11/1994 |
| JP | 7-213204 | A | 8/1995 |
| JP | 2001-192023 | A | 7/2001 |
| JP | 2003-119402 | A | 4/2003 |
| JP | 2003-284800 | A | 10/2003 |

* cited by examiner

*Primary Examiner*—Raeann Trimiew
(74) *Attorney, Agent, or Firm*—Sughrue Mion, PLLC

(57) ABSTRACT

A golf ball which reduces the impact on the environment is provided. The golf ball, which may be a one-piece ball or a ball having a core and a cover of one or more layer, is composed at least in part of a biodegradable material.

34 Claims, No Drawings

GOLF BALL

CROSS-REFERENCE TO RELATED APPLICATION

This non-provisional application claims priority under 35 U.S.C. §119(a) on Patent Application No. 2005-070193 filed in Japan on Mar. 14, 2005, the entire contents of which are hereby incorporated by reference.

BACKGROUND OF THE INVENTION

1. Field of the Invention

The present invention relates to a golf ball, and more particularly to a golf ball made by use of a biodegradable material not harmful to the environment.

2. Prior Art

Prior-art golf balls include one-piece balls, two-piece balls, three-piece balls, and multi-layer balls having an even larger number of layers. Concrete materials used in such golf balls include, as core materials: thermoplastic elastomers such as natural rubber, butadiene rubber, isoprene rubber and styrene-butadiene rubber; and as cover materials enclosing the core: thermoplastic resins such as ionomers, polyamides, polyesters, polyetheresters, polyetheramides and thermoplastic polyurethanes, and thermoset resins such as polyureas, thermoset polyurethanes, epoxy resins, polyphenols, polysilicones and urea-melamine resins. These golf balls are mass-produced by processes such as injection molding and compression molding in a volume of some hundreds of millions of balls annually.

Used golf balls are generally disposed of in a landfill or incinerated, although a certain proportion of golf balls end up as lost balls or are otherwise abandoned to the environment. Because the above materials used as ingredients of golf balls are unlikely to be biodegradable to any substantial extent, there is some concern over the adverse impact of such abandoned golf balls on the environment. JP-A 7-213204, JP-A 2001-192023 and JP-A 2003-284800 indicate the use of biodegradable materials in the production of fishing gear, boxes for packaging golf balls, and shuttlecocks. Yet, when it comes to golf balls produced in a larger volume than these other products, there exists an unmet need for the development of technology to manufacture golf balls not harmful to the environment.

SUMMARY OF THE INVENTION

It is therefore an object of the invention to provide golf balls having a lower impact on the environment.

It was found that by consisting of a biodegradable material as at least one ingredient of a golf ball, and particularly by forming a golf ball using a biodegradable material designed as a mixture of a biodegradable compound with, for example, a thermoplastic resin in a specific form to compatibilize both ingredients in a ratio, the formation of a golf ball not harmful to the environment can be achieved.

Accordingly, the invention provides a golf ball composed of a biodegradable material as at least an ingredient of the golf ball. Preferably, the golf ball is a one-piece golf ball composed of the biodegradable material, or a golf ball consisted of a biodegradable material as at least an ingredient of both a core and a cover of one layer or multi-layers.

In one aspect of the invention, the biodegradable material includes at least one ester group-containing biodegradable compound.

In another aspect of the invention, the biodegradable material includes at least one ester group-free biodegradable compound.

The biodegradable material of either of the foregoing aspects of the invention is also a mixture of the biodegradable compound with a thermoplastic resin, a thermoplastic elastomer and/or a thermoset resin.

It is preferable for the mixture prepared by blending the biodegradable compound with a thermoplastic resin, thermoplastic elastomer and/or thermoset resin in a weight ratio, described as (biodegradable compound)/(total amount of thermoplastic resin, thermoplastic elastomer and thermoset resin), of from 5/95 to 95/5. The mixture has an interpenetrating polymer network structure.

DETAILED DESCRIPTION OF THE INVENTION

As described above, the golf ball of the invention is composed of a biodegradable material as at least an ingredient of the golf ball. It is preferable for the golf ball to be a one-piece golf ball composed of the biodegradable material, or a ball composed of the biodegradable material as at least an ingredient of both a core and a cover of one layer or multi-layers. By having a biodegradable material as at least one ingredient of the golf ball, the impact of the inventive golf ball on the environment can be reduced even if the ball is lost or abandoned.

As used herein, "biodegradable material" refers to a material containing one or more biodegradable compound. Moreover, "biodegradable compound" refers to a compound which is at least partially decomposed by microorganisms in the soil, manure or compost.

Illustrative, non-limiting examples of the biodegradable compound include ester group-containing biodegradable compounds, such as polylactic acid, cellulose acetate, caprolactone-butylene succinate, polybutylene adipate terephthalate, polybutylene succinate, adipate-modified polybutylene succinate, polycaprolactone, carbonate-modified polybutylene succinate, polyethylene terephthalate succinate, polyethylene succinate, polyethylene oxalate, polyhydroxybutyrate, polyglycolic acid, polybutylene oxalate, polyneopentyl glycol oxalate, polyhydroxybutyric acid, β-hydroxybutyric acid/β-hydroxyvaleric acid copolymers, lactic acid-modified products (e.g., lactic acid-polyol-polybasic acid copolymers), starch-based resins (e.g., starch fatty acid esters, starch polyesters), and acid-modified polyvinyl alcohols; and ester group-free biodegradable compounds, such as polyglutamic acid, polycaprolactam, polyethylene glycol, polypropylene glycol, polysaccharides (e.g., starch, chitin, chitosan, cellulose), and polyvinyl alcohol. These can be used singly or as combinations of two or more thereof.

In working the invention, of the above compounds, for good moldability and biodegradability, it is especially preferable to use one or more ester group-containing biodegradable compounds. The use of polylactic acid or polyglutamic acid is especially preferred.

No particular limitation is imposed on the molecular weight of the biodegradable compounds used in the invention. Appropriate use can be made of compounds ranging from oligomers to moldable high-molecular-weight polymers.

Commercial products may be used as the above biodegradable compounds. Illustrative examples include CELLGREEN (produced by Daicel Chemical Industries, Ltd.), LACEA (Mitsui Chemicals, Inc.), TONE (Union Carbide Chemical and Plastics Co., Inc.), Bacteria Cellulose (Biomaterial), Biomax (Du Pont), PLA (Cargill), Biopore (Zeneca), Curdlan (Takeda Chemical Industries, Ltd.), Bionolle (Showa Highpolymer Co., Ltd.) and γ-PGA (Nippon Poly-Glu Co., Ltd.).

The above-described biodegradable compounds are among the biodegradable materials as at least one ingredient of the golf ball in the invention. The amount of the biodegradable compound as a proportion of the biodegradable material is generally from 10 to 90 wt %, and preferably from 20 to 80 wt %. A smaller proportion of the biodegradable material may significantly reduce the biodegradability.

In addition to biodegradability, to compatibly impart processability and such golf ball properties as surface glossiness and rebound resilience, the biodegradable material used in the invention can be formulated with a thermoplastic resin, a thermoplastic elastomer and/or a thermoset resin. That is, one or more materials selected from the group consisting of thermoplastic resins, thermoplastic elastomers and thermoset resins can be formulated with the biodegradable material.

Illustrative examples of appropriate thermoplastic resins include ethylene-(meth)acrylic acid copolymers, ethylene-(meth)acrylic acid-(meth)acrylate ester copolymers, ionomers, polyamides, polyesters, polyetheresters, polyetheramides, thermoplastic polyurethanes, polyethylenes, polypropylenes, polystyrenes, ABS, polyacetals, cellulosic resins, polymethacrylates and polyethylene terephthalates. Here, "(meth)acrylic acid" means methacrylic acid or acrylic acid, and "(meth)acrylate" means methacrylate or acrylate. Illustrative examples of appropriate thermoplastic elastomers include styrene-based thermoplastic elastomers, urethane-based thermoplastic elastomers, ester-based thermoplastic elastomers, olefin-based thermoplastic elastomers, vinyl chloride-based thermoplastic elastomers, fluorocarbon-based thermoplastic elastomers, butadiene-based thermoplastic elastomers, amide-based thermoplastic elastomers, and also rubbers such as natural rubber, butadiene rubber, isoprene rubber, styrene-butadiene rubber, ethylene-propylene-diene rubber, butyl rubber and hydrogenated isoprene rubber.

Illustrative examples of appropriate thermoset resins include polyureas, thermoset polyurethanes, epoxy resins, polyphenols, polysilicones, urea-melamine resins, unsaturated polyesters and diallyl phthalate resins.

For good blending and mixing with the biodegradable compound, it is preferable to formulate a thermoplastic resin with the biodegradable compound. The above thermoplastic resin, thermoplastic elastomer and/or thermoset resin is blended with the biodegradable compound in a weight ratio, described as (biodegradable compound)/(total amount of thermoplastic resin, thermoplastic elastomer and thermoset resin), of generally from 5/95 to 95/5, preferably from 10/90 to 90/10, and more preferably from 20/80 to 80/20. If the biodegradable compound is blended together with a thermoset resin, it is preferable from a viewpoint of good moldability to be in the weight ratio, described as (biodegradable compound)/(total amount of thermoset resin), ranging from 95/5 to 55/45.

When the above-described mixture of a biodegradable compound with a thermoplastic resin, thermoplastic elastomer and/or thermoset resin is used as the biodegradable material in the invention, from a viewpoint of ensuring the uniformity of the mixture and the rebound resilience and impact resistance of the golf ball obtained therefrom, it is preferable to have an interpenetrating polymer network (IPN) structure in the mixture. "IPN structure" refers herein to a network structure composed of two or more different types of entangled polymers which have chemical interactions (including crosslinkages) between the same polymer molecules, not having the interactions between the different polymer molecules.

Generally, different types of polymers have differing cohesive energy densities respectively, leading to difficulty in compatibilizing one another. However a more uniformity in the mixture of the biodegradable compound with the thermoplastic resin, thermoplastic elastomer and/or thermoset resin, can be achieved by an IPN method that involves melt blending a biodegradable compound having no functional groups with a thermoplastic resin, thermoplastic elastomer and/or thermoset resin having functional groups (e.g., carboxylic acids, unsaturated bonds), or melt blending a biodegradable compound having functional groups (e.g., carboxylic acids, hydroxyl groups) with a thermoplastic resin, thermoplastic elastomer and/or thermoset resin lacking functional groups, then carring out chemical bonding (intermolecular crosslinking) through the functional groups between the same kind of polymer molecules.

Whether the mixture actually has an IPN structure can be ascertained-by comparing the each area of the polymer crystal-melting endothermic peaks measured by differential scanning calorimetry (DSC) on the respective materials and the chemically bonded mixture. If the chemically bonded mixture has an IPN structure in itself, the endothermic peak areas are reduced, compared with those of the respective materials and the simply melt-blended thereof.

Illustrative examples of combinations capable of manifesting an IPN structure include the combination of a polylactic acid as the biodegradable compound lacking functional groups with an ethylene-methacrylic acid copolymer as the thermoplastic resin having functional groups (carboxylic acids), the combination of a polylactic acid as the biodegradable compound lacking functional groups with a polybutadiene as the thermoplastic elastomer having functional groups (unsaturated bonds), the combination of a polyglutamic acid as the biodegradable compound having functional groups (carboxylic acids) with an ethylene-methacrylic acid-isobutyl acrylate copolymer as the thermoplastic resin having functional groups (carboxylic acids), and the combination of a polylactic acid as the biodegradable compound lacking functional groups with a thermoplastic polyurethane (polyethylene glycol (hydroxyl groups) and diphenylmethane diisocyanate (isocyanate groups)) as the thermoplastic resin having functional groups. When the functional groups in these melt blends are carboxylic acids, a metal salt (e.g., a metal hydroxide, metal carbonate, metal acetate or mixture thereof composed of lithium, sodium, magnesium, aluminum, potassium, calcium, manganese, tungsten, titanium, iron, cobalt, nickel, hafnium, copper, zinc, barium, zirconium or tin) can be added to form a biodegradable material having an IPN structure with metal ionic bonds. Alternatively, when the functional groups in these melt blends are unsaturated bonds, a radical generator such as a peroxide (e.g., benzoyl peroxide, dicumyl peroxide, t-butyl peroxide) can be added to form a biodegradable material having an IPN structure with covalent bonds.

The resulting biodegradable material with an IPN structure has a more uniform structure than the melt blends. Hence, as a golf ball material, it provides such desirable properties as an improved scuff resistance and improved durability without reducing the rebound resilience.

To modify the specific gravity and soften the impact feeling of the resulting golf ball, it is also possible to include a blowing agent in the above-described biodegradable material and to handle the biodegradable material as a foam.

Illustrative examples of blowing agents used for this purpose include sodium bicarbonate, silicone oil blowing agents (e.g., methylhydrogen silicone oil), foamable microcapsules, azodicarbonamide, dinitrosopentamethylenetetramine.

Commercial products used as the blowing agent include Polon MF-16 (Shin-Etsu Chemical Co., Ltd.), TSF-484 (Toshiba Silicone Co., Ltd.), Matsumotomicrosphere F-30 (Matsumoto Yushi-Seiyaku Co., Ltd.) and Cellmic C (Sankyo Kasei Co., Ltd.).

The amount of the blowing agent used as a proportion of the biodegradable material is generally from 0.1 to 20 wt %, and preferably from 1 to 10 wt %. If a smaller portion of the blowing agent is used, the forming expansion becomes insufficient to achieve the desired specific gravity.

To enhance the impact resistance of the resulting golf ball, a crosslinking agent can be included in the biodegradable material for the purpose of introducing therein a crosslinked structure.

Illustrative examples of the crosslinking agent used in this case include peroxides such as benzoyl peroxide, dicumyl peroxide and t-butyl peroxide; acrylate crosslinkers such as ethylene diacrylate; unsaturated carboxylic acids and the metal salts of unsaturated carboxylic acids (e.g., acrylic acid, methacrylic acid, and these carboxylic acids neutralized with metal cations), glycidyl methacrylate and γ-methacryloxypropyltrimethoxysilane.

The amount of the crosslinking agent used as a proportion of the biodegradable material is generally from 0.01 to 10 wt %, and preferably from 0.1 to 5 wt %. A smaller portion of the crosslinking agent reduces the durability of the ball, whereas a larger portion of it reduces the flow properties of the material.

In addition, various other additives can be suitably included in the biodegradable material. Examples of such additives include organic fillers such as pigments and dyes, inorganic fillers such as titanium oxide, antioxidants, ultraviolet absorbers, mold release agents and antistatic agents. These can be used singly or as combinations of two or more thereof.

The golf ball of the invention is composed of the above-mentioned biodegradable materials used as at least one ingredient of the golf ball, although the ingredient consisted of the biodegradable material can serve as the entire golf ball. No particular limitation is imposed on the structure of the inventive golf ball. For example, the golf ball includes a thread-wound ball (with a single-layer cover or a multi-layer cover of two or more layers), a one-piece ball, a two-piece ball, a three-piece ball, or a multi-piece ball having a cover of three or more layers. To obtain the inventive golf ball, the above-described biodegradable material is variously modified to apply for a one-piece ball material, the solid center of a thread-wound golf ball, the solid core material or cover material (if the core or cover has two or more layers, at least one layer thereof) of a solid golf ball, or a coating material for the surface of the ball, then is used in accordance with a known method to manufacture the golf ball.

In the golf ball formed as described above, the diameter, weight, hardness and other properties of the above-described cover, the solid or liquid center, the solid core or thread-wound core, the one-piece golf ball, the two-piece golf ball, the three-piece golf ball and the multi-piece golf ball having a cover of three or more layers can be appropriately adjusted insofar as the objects of the invention are achievable. If the golf ball of the invention is to be used in tournaments, it should be formed to a diameter of not less than 42.67 mm and a weight of not more than 45.93 g.

The golf ball of the invention can help alleviate environmental pollution, even should it be buried in a landfill following use or become a lost ball at a practice driving range or golf course.

EXAMPLES

The following Examples of the invention, References and Controls are provided by way of illustration and not by way of limitation.

Example 1

Production of One-Piece Golf Ball Made Only of Biodegradable Material

The formulation shown in Table 1 was melt blended with a twin-screw extruder (setting temperatures: C1, 180° C.; C2, 210° C.; C3, 210° C.; C4/die, 200° C.) at an extrusion rate of 5.5 kg/h to give a pelletized blend. The blend was then injection molded using an injection molding machine (setting temperatures: hopper, 160° C.; C1 to head, 180° C.) at an injection pressure of 5.9 MPa, a holding pressure of 4.9 MPa, an injection and holding time of 8 seconds, a cooling time of 25 seconds, and cooling in water, thereby producing one-piece golf balls.

The biodegradability and rebound resilience of the resulting golf balls were evaluated. The results are shown in Table 1.

Example 2

Production of Two-Piece Golf Ball Made Only of Biodegradable Materials

First, using the same injection molding machine as in Example 1, a core (36 mm diameter) was molded under the same conditions as in Example 1 from the starting materials shown in Table 1. Next, a uniform and pelletized blend of the cover material was obtained using the twin-screw extruder described in Example 1 under the same conditions. The cover material then overmolded the core under the same injection molding conditions as described in Example 1, thereby giving a two-piece golf ball.

The biodegradability and rebound resilience of the resulting golf balls were evaluated. The results are shown in Table 1.

Example 3

Production of Two-Piece Golf Ball with Cover Made Only of Biodegradable Material First, a core was molded under applied pressure from the starting materials shown in Table 1, then the cover material overmolded the core under the same injection molding conditions as in Example 1, giving a two-piece golf ball.

The biodegradability and rebound resilience of the resulting golf balls were evaluated. The results are shown in Table 1.

Example 4

Production of Two-Piece Golf Ball with Cover Made of Biodegradable Material Melt-blended with Ionomer A cover material was prepared as a uniform and pelletized blend from the cover starting materials shown in Table 1 using the twin-screw extruder described in Example 1. The resulting cover material overmolded the same core as that used in Example 3 under the injection molding conditions in Example 1, thereby giving a two-piece golf ball.

The biodegradability and rebound resilience of the resulting golf balls were evaluated. The results are shown in Table 1.

Example 5

Production of Two-Piece Golf Ball with Cover Made of Biodegradable Material Melt-blended with Ionomer in a Different Ratio A cover material was prepared as a uniform and pelletized blend from the cover starting materials shown in Table 1 using the twin-screw extruder described in Example 1. The resulting cover material overmolded the same core as that used in Example 3 under the injection molding conditions in Example 1, thereby giving a two-piece golf ball.

The biodegradability and rebound resilience of the resulting golf balls were evaluated. The results are shown in Table 1.

Reference 1

Preparation of Golf Ball Core Containing Biodegradable Material

Using the starting materials shown in Table 1, first BP-a and TP-x were mixed in a Labo Plastomill (setting temperature: 170° C.) at a 50 rpm for 7 minutes. Next, dicumyl peroxide was added as a crosslinking agent and the setting temperature was changed to 180° C. followed by 5-minute mixing, thereby giving a uniform core material. From DSC measurements on the obtained core material showed that the Lacea's crystal-melting endothermic peak (160 to near 170° C.) decreased, compared with the corresponding peak of the not crosslinked melt blend, it was apparent that the core material obtained here was a uniform material having an IPN structure with a higher rebound resilience than the BP-b core, being suitable for use as a golf ball core material.

Test specimens having a thickness of 1 mm and a length and width of 100 mm were prepared from this core material, and the biodegradability was evaluated. The results are presented in Table 1.

Reference 2

Preparation of Golf Ball Cover Material Containing Biodegradable Material

Using the starting materials shown in Table 1, first BP-a and TP-z were mixed with a Laboplastomill (setting temperature: 180° C.) at a 50 rpm for 7 minutes. Next, zinc oxide (average particle size, 20 nm) was added followed by 5-minute mixing at the same temperature, thereby giving a uniform ionomer material (capable of being used as an intermediate layer or a cover). From DSC measurements on the obtained ionomer material showed that the crystal-melting endothermic peaks of the polyethylene and ionic clusters in the ionomer decreased, compared with the corresponding peaks of a melt blend of the same Lacea with a zinc ionomer of the ethylene-methacrylic acid copolymer in the same ratio as the above ionomer, it was apparent that the ionomer material obtained here having an IPN structure was more uniform than a melt blend of BP-a and TP-y, suitable for use as a golf ball cover material.

Test specimens having 1 mm in thickness with 100 mm in length and width were prepared from this cover material, and the biodegradability was evaluated. The results are presented in Table 1.

Control 1

Prior-Art One-Piece Golf Ball

A one-piece golf ball was produced by compression molding at 180° C. using the starting materials shown in Table 1 (conventional prior-art composition).

The biodegradability and rebound resilience of the resulting golf balls were evaluated. The results are shown in Table 1.

Control 2

Prior-Art Two-Piece Golf Ball

Pinnacle Exception, a golf ball manufactured by Acushnet Co., which has a Surlyn (ionomer) cover and a butadiene core was selected as an example of a commercial golf ball and used here for the purpose of comparison.

The biodegradability and rebound resilience of the resulting golf balls were evaluated. The results are shown in Table 1.

TABLE 1

| | | | Examples of Invention | | | | | Reference Example | | Comparative Example | |
|---|---|---|---|---|---|---|---|---|---|---|---|
| | | | 1 | 2 | 3 | 4 | 5 | 1 | 2 | 1 | 2 |
| One-piece golf ball | | Starting materials | BP-a/ titanium oxide/ blue pigment = 100/3/0.1 | — | — | — | — | — | — | TP-x/ methacrylic acid/ zinc oxide/ dicumyl peroxide = 100/20/20/1 | |
| | | IPN structure | no | — | — | — | — | — | — | no | |
| Two-piece golf ball | Core | Starting materials | — | BP-b | TP-x/ zinc acrylate/ zinc oxide/ | TP-x/ zinc acrylate/ zinc oxide/ | TP-x/ zinc acrylate/ zinc oxide/ | BP-a/ TP-x/ dicumyl peroxide = 75/25/1 | — | — | Commercial golf ball |

TABLE 1-continued

| | | Examples of Invention | | | | | Reference Example | | Comparative Example | |
|---|---|---|---|---|---|---|---|---|---|---|
| | | 1 | 2 | 3 | 4 | 5 | 1 | 2 | 1 | 2 |
| | | | | dicumyl peroxides = 100/30/10/1 | dicumyl peroxide = 100/30/10/1 | dicumyl peroxide = 100/30/10/1 | | | | |
| | IPN structure | — | no | no | no | no | yes | — | — | |
| Cover | Starting materials | — | BP-a/ titanium oxide/ blue pigment = 100/3/0.1 | BP-b | BP-a/ titanium oxide/ blue pigment/ TP-y = 80/3/0.1/20 | BP-a/ titanium oxide/ blue pigment/ TP-y = 20/3/0.1/80 | — | BP-a/ zinc oxide/ TP-z = 60/1.7/40 | — | |
| | IPN structure | — | no | no | no | no | — | yes | — | |
| Biodegradability | | Excellent | Excellent | Excellent | Excellent | Good | Excellent | Excellent | NG | NG |
| Rebound resilience (%) | | 63 | 63 | 84 | 77 | 81 | — | — | 82 | 83 |

BP-a: Lacea M-151S Q52 (produced by Mitsui Chemicals, Inc.; an impact-resistant grade of polylactic acid, as the biodegradable material; MFR, 17 g/10 min)
BP-b: Lacea H-100J (produced by Mitsui Chemicals, Inc.; a general-purpose grade of polylactic acid which is a mixture of polylactic acid and aliphatic dicarboxylic acid polyester; MFR, 8 g/10 min)
TP-x: BR01 (produced by JSR Corporation; cis-1,4 bond content, 96%; prepared with a nickel polymerization catalyst)
TP-y: An ethylene-methacrylic acid copolymer in which the methacrylic acids are neutralized with metal cations (Himilan H1605/H1706 blend; produced by DuPont-Mitsui Polychemicals Co., Ltd.)
TP-z: An ethylene-methacrylic acid copolymer (Nucrel N1560; produced by DuPont-Mitsui Polychemicals Co., Ltd.)

Evaluation of Biodegradability

Biodegradability was rated as follows. Changes in the glossiness at the surface of the molded articles were not considered.

| | |
|---|---|
| Excellent: | The surface of the molded article changed significantly after one year, indicating substantial biodegradability. |
| Good: | The surface of the molded article changed slightly after one year, indicating some biodegradability. |
| NG: | The surface of the molded article did not change after one year, showing no evidence of biodegradability. |

Rebound Resilience (%)

The rebound resilience was measured by the ball drop (free-fall drop) method. The golf ball was freely dropped from a height of 1,000 mm (drop height) onto an iron plate (125 mm in diameter; 100 mm in thickness; 10.206 kg in weight), and the rebound height of it was measured. The rebound resilience of the dropped ball is the ratio of the rebound height to the drop height, described as a percentage.

Japanese Patent Application No. 2005-070193 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball which is a one-piece golf ball comprising a biodegradable material, or a golf ball comprising a biodegradable material as at least an ingredient of both a core and a cover of one layer or multi-layers, wherein the biodegradable material is capable of being at least partially decomposed by microorganisms in the soil, manure or compost, and the biodegradable material is selected from the group consisting of a combination of a biodegradable compound lacking functional groups with a thermoplastic resin having functional groups, a combination of a biodegradable compound lacking functional groups with a thermoplastic elastomer having functional groups, and a combination of a biodegradable compound having functional groups with a thermoplastic resin having functional groups, wherein said biodegradable material has an interpenetrating polymer network structure.

2. The golf ball of claim 1, wherein said ball is a one piece golf ball composed of the biodegradable material.

3. The golf ball of claim 1, wherein said ball includes as ingredients a core and a cover of one or more layer, both of which ingredients are composed of the biodegradable material.

4. The golf ball of claim 1, wherein the biodegradable material is prepared by blending the biodegradable compound with said at least one substance selected from the group consisting of thermoplastic resins and thermoplastic elastomers in a weight ratio, described as (biodegradable compound)/(total amount of thermoplastic resin and thermoplastic elastomer), of from 5/95 to 95/5.

5. The golf ball of claim 1, wherein the biodegradable compound lacking functional groups is polylactic acid.

6. The golf ball of claim 1, wherein the biodegradable compound having functional groups is polyglutamic acid.

7. The golf ball of claim 6, wherein the thermoplastic resin or the thermoplastic elastomer having functional groups is selected from the group consisting of an ethylene-(meth) acrylic acid copolymer, an ethylene-(meth)acrylic acid-isobutyl acrylate copolymer, a thermoplastic polyurethane and a polybutadiene.

8. The golf ball of claim 7, wherein the functional groups are carboxylic acids and a metal salt is added to form a biodegradable material having an IPN structure with metal ionic bonds.

9. The golf ball of claim 7, wherein the functional groups are unsaturated bonds, and a radical generator is added to form a biodegradable material having an IPN structure with covalent bonds.

10. The golf ball of claim 1, wherein a metal salt is added to the biodegradable material when the functional groups in the blends are carboxylic acids.

11. The golf ball of claim 10, wherein the metal salt is selected from a metal hydroxide, metal carbonate, metal acetate and or mixture thereof composed of lithium, sodium, magnesium, aluminum, potassium, calcium, manganese, tungsten, titanium, iron, cobalt, nickel, hafnium, copper, zinc, barium, zirconium or tin.

12. The golf ball of claim 1, which has a diameter of not less than 42.67 mm and a weight of not more than 45.93 g.

13. A golf ball comprising a biodegradable material that is capable of being at least partially decomposed by microorganisms in the soil, manure or compost, wherein the biodegradable material includes at least one ester group-containing biodegradable compound, wherein the biodegradable material is a mixture of the biodegradable compound with at least one substance selected from the group consisting of thermoplastic resins, thermoplastic elastomers and thermoset resins, wherein said mixture has an interpenetrating polymer network structure, wherein the combination capable of manifesting an IPN structure is selected from a group consisting of a combination of a biodegradable compound lacking functional groups with a thermoplastic resin having functional groups, a combination of a biodegradable compound lacking functional groups with a thermoplastic elastomer having functional groups, and a combination of a biodegradable compound having functional groups with a thermoplastic resin having functional groups.

14. The golf ball of claim 13, wherein said ball is a one piece golf ball composed of the biodegradable material.

15. The golf ball of claim 13, wherein said ball includes as ingredients a core and a cover of one or more layer, at least one of which ingredients is composed of the biodegradable material.

16. The golf ball of claim 13, wherein the mixture is prepared by blending the biodegradable compound with said at least one substance selected from the group consisting of thermoplastic resins, thermoplastic elastomers and thermoset resins in a weight ratio, described as (biodegradable compound)/(total amount of thermoplastic resin, thermoplastic elastomer and thermoset resin), of from 5/95 to 95/5.

17. The golf ball of claim 13, wherein the ester group-containing biodegradable compound is selected from a group consisting of polylactic acid, cellulose acetate, caprolactonebutylene succinate, polybutylene adipate terephthalate, polybutylene succinate, adipate-modified polybutylene succinate, polycaprolactone, carbonate-modified polybutylene succinate, polyethylene terephthalate succinate, polyethylene succinate, polyethylene oxalate, polyhydroxybutyrate, polyglycolic acid, polybutylene oxalate, polyneopentyl glycol oxalate, polyhydroxybutyric acid, β-hydroxybutyric acid/β-hydroxyvaleric acid copolymers, lactic acid-modified products, starch-based resins and acid-modified polyvinyl alcohols.

18. The golf ball of claim 13, wherein the ester group-free biodegradable compound is selected from the group consisting of polyglutamic acid, polycaprolactam, polyethylene glycol, polypropylene glycol, polysaccharides and polyvinyl alcohol.

19. The golf ball of claim 13, wherein the biodegradable compound lacking functional groups is polylactic acid.

20. The golf ball of claim 13, wherein a biodegradable compound having functional groups is polyglutamic acid.

21. The golf ball of claim 20, wherein the thermoplastic resin or the thermoplastic elastomer having functional groups is selected from the group consisting of an ethylene-(meth) acrylic acid copolymer, an ethylene-(meth)acrylic acid-isobutyl acrylate copolymer, a thermoplastic polyurethane and a polybutadiene.

22. The golf ball of claim 21, wherein the functional groups are carboxylic acids and a metal salt is added to form a biodegradable material having an IPN structure with metal ionic bonds.

23. The golf ball of claim 22, wherein the functional groups are unsaturated bonds, and a radical generator is added to form a biodegradable material having an IPN structure with covalent bonds.

24. A golf ball comprising a biodegradable material that is capable of being at least partially decomposed by microorganisms in the soil, manure or compost, wherein the biodegradable material includes at least one ester group-free biodegradable compound, wherein the biodegradable material is a mixture of the biodegradable compound with at least one substance selected from the group consisting of thermoplastic resins, thermoplastic elastomers and thermoset resins, wherein said mixture has an interpenetrating polymer network structure, wherein the combination capable of manifesting an IPN structure is selected from a group consisting of a combination of a biodegradable compound lacking functional groups with a thermoplastic resin having functional groups, a combination of a biodegradable compound lacking functional groups with a thermoplastic elastomer having functional groups, and a combination of a biodegradable compound having functional groups with a thermoplastic resin having functional groups.

25. The golf ball of claim 24, wherein said ball is a one piece golf ball composed of the biodegradable material.

26. The golf ball of claim 24, wherein said ball includes as ingredients a core and a cover of one or more layer, at least one of which ingredients is composed of the biodegradable material.

27. The golf ball of claim 24, wherein the mixture is prepared by blending the biodegradable compound with said at least one substance selected from the group consisting of thermoplastic resins, thermoplastic elastomers and thermoset resins in a weight ratio, described as (biodegradable compound)/(total amount of thermoplastic resin, thermoplastic elastomer and thermoset resin), of from 5/95 to 95/5.

28. The golf ball of claim 24, wherein the ester group-containing biodegradable compound is selected from a group consisting of polylactic acid, cellulose acetate, caprolactonebutylene succinate, polybutylene adipate terephthalate, polybutylene succinate, adipate-modified polybutylene succinate, polycaprolactone, carbonate-modified polybutylene succinate, polyethylene terephthalate succinate, polyethylene succinate, polyethylene oxalate, polyhydroxybutyrate, polyglycolic acid, polybutylene oxalate, polyneopentyl glycol oxalate, polyhydroxybutyric acid, β-hydroxybutyric acid/

β-hydroxyvaleric acid copolymers, lactic acid-modified products, starch-based resins and acid-modified polyvinyl alcohols.

29. The golf ball of claim 24, wherein the ester group-free biodegradable compound is selected from the group consisting of polyglutamic acid, polycaprolactam, polyethylene glycol, polypropylene glycol, polysaccharides and polyvinyl alcohol.

30. The golf ball of claim 24, wherein the biodegradable compound lacking functional groups is polylactic acid.

31. The golf ball of claim 24, wherein a biodegradable compound having functional groups is polyglutamic acid.

32. The golf ball of claim 31, wherein the thermoplastic resin or the thermoplastic elastomer having functional groups is selected from the group consisting of an ethylene-(meth) acrylic acid copolymer, an ethylene-(meth)acrylic acid-isobutyl acrylate copolymer, a thermoplastic polyurethane and a polybutadiene.

33. The golf ball of claim 32, wherein the functional groups are carboxylic acids and a metal salt is added to form a biodegradable material having an IPN structure with metal ionic bonds.

34. The golf ball of claim 33, wherein the functional groups are unsaturated bonds, and a radical generator is added to form a biodegradable material having an IPN66 structure with covalent bonds.

* * * * *